US007145469B2

(12) United States Patent
Kokonaski et al.

(10) Patent No.: US 7,145,469 B2
(45) Date of Patent: Dec. 5, 2006

(54) DISPLAY SYSTEM FOR USE ON HORIZONTAL OR NON-HORIZONTAL SURFACES

(75) Inventors: William Kokonaski, Gig Harbor, WA (US); Ronald D. Blum, Roanoke, VA (US); Youval Katzman, Zichron Yaaqov (IL); Boaz Harari, Haifa (IL); Kobby Greenburg, Even-Yehuda (IL)

(73) Assignee: Intellimats, LLC, Roanoke, VA (US)

( * ) Notice: Subject to any disclaimer, the term of this patent is extended or adjusted under 35 U.S.C. 154(b) by 0 days.

(21) Appl. No.: 11/002,276

(22) Filed: Dec. 3, 2004

(65) Prior Publication Data

US 2005/0134474 A1 Jun. 23, 2005

Related U.S. Application Data

(63) Continuation-in-part of application No. 10/454,631, filed on Jun. 5, 2003, and a continuation-in-part of application No. 10/438,923, filed on May 16, 2003, and a continuation-in-part of application No. 10/285,639, filed on Nov. 1, 2002, now Pat. No. 6,873,266, which is a continuation of application No. 10/137,357, filed on May 3, 2002, now Pat. No. 6,507,285, which is a continuation of application No. 09/767,846, filed on Jan. 24, 2001, now Pat. No. 6,417,778, which is a continuation of application No. 09/418,752, filed on Oct. 15, 1999, now abandoned, which is a continuation-in-part of application No. 09/304,051, filed on May 4, 1999, now Pat. No. 6,219,876, said application No. 11/002,276 is a continuation-in-part of application No. 10/759,167, filed on Jan. 20, 2004, and a continuation-in-part of application No. 10/682,435, filed on Oct. 10, 2003, now Pat. No. 6,917,301, and a continuation-in-part of application No. 10/438,923, filed on May 16, 2003.

(60) Provisional application No. 60/526,271, filed on Dec. 3, 2003, provisional application No. 60/441,408, filed on Jan. 22, 2003, provisional application No. 60/429,044, filed on Nov. 23, 2002, provisional application No. 60/428,387, filed on Nov. 21, 2002, provisional application No. 60/418,626, filed on Oct. 12, 2002, provisional application No. 60/385,579, filed on Jun. 5, 2002, provisional application No. 60/378,070, filed on May 16, 2002.

(51) Int. Cl.
*G08B 5/00* (2006.01)

(52) U.S. Cl. ..... 340/815.4; 40/768; 361/681; 362/382

(58) Field of Classification Search ..... 340/815.4, 340/691.6; 361/681; 345/30; 40/446, 463, 40/768, 775, 776, 790; 362/362, 382, 418, 362/430

See application file for complete search history.

(56) References Cited

U.S. PATENT DOCUMENTS 2,191,704 A 2/1940 Bennett
(Continued)

FOREIGN PATENT DOCUMENTS

DE 3147113 11/1981
(Continued)

OTHER PUBLICATIONS

Related co-pending U.S. Appl. No. 10/373,191, filed Feb. 26, 2003.
(Continued)

*Primary Examiner*—Thomas Mullen
(74) *Attorney, Agent, or Firm*—Kenyon & Kenyon LLP

(57) ABSTRACT

Embodiments of the present invention relate to display system comprising an electronic display device housed within a supporting fixture, where the supporting fixture may be capable of being arranged on a substantially horizontal surface such as a floor and walked over, or of being mounted on a non-horizontal surface, including a substantially vertical surface such as a wall. To this end, the electronic display device and supporting fixture may be thin and lightweight, while also being durable and shock resistant. Control electronics for the display device may be arranged in such a way that space is conserved.

22 Claims, 6 Drawing Sheets

U.S. PATENT DOCUMENTS

| | | | |
|---|---|---|---|
| 2,254,830 | A | 9/1941 | Schloss |
| 2,282,672 | A | 5/1942 | Nelson |
| 2,512,310 | A | 6/1950 | Corson |
| 2,800,215 | A | 7/1957 | Bennett |
| 2,843,868 | A | 7/1958 | Borgstorm |
| 2,919,456 | A | 1/1960 | Spivey |
| 3,078,490 | A | 2/1963 | Etcher |
| 3,083,393 | A | 4/1963 | Nappi |
| 3,141,522 | A | 7/1964 | Fitzpatrick |
| 3,183,116 | A | 5/1965 | Schaar |
| 3,300,275 | A | 1/1967 | Lorman |
| 3,400,421 | A | 9/1968 | Nappi et al. |
| 3,435,481 | A | 4/1969 | Kessler |
| 3,501,797 | A | 3/1970 | Nappi |
| 3,517,407 | A | 6/1970 | Wyant |
| 3,578,738 | A | 5/1971 | Hughes |
| 3,663,980 | A | 5/1972 | Conklin |
| 3,665,543 | A | 5/1972 | Nappi |
| 3,696,459 | A | 10/1972 | Kucera et al. |
| 3,699,926 | A | 10/1972 | Stockl |
| 3,717,897 | A | 2/1973 | Amos et al. |
| 3,785,102 | A | 1/1974 | Amos |
| 3,886,620 | A | 6/1975 | Miller et al. |
| 3,906,578 | A | 9/1975 | Huber |
| 3,909,996 | A | 10/1975 | Ettinger, Jr. et al. |
| 3,916,401 | A | 10/1975 | Freeman |
| 3,930,084 | A | 12/1975 | Shields |
| 4,107,811 | A | 8/1978 | Imsande |
| 4,126,854 | A | 11/1978 | Sheridon |
| 4,143,103 | A | 3/1979 | Sheridon |
| 4,143,194 | A | 3/1979 | Wihksne |
| 4,328,275 | A | 5/1982 | Vargo |
| 4,353,944 | A | 10/1982 | Tarui |
| 4,421,809 | A | 12/1983 | Bish et al. |
| 4,435,451 | A | 3/1984 | Neubert |
| 4,439,474 | A | 3/1984 | Sagel |
| 4,482,593 | A | 11/1984 | Sagel et al. |
| 4,484,250 | A | 11/1984 | Rzepecki et al. |
| 4,559,250 | A | 12/1985 | Paige |
| 4,564,546 | A | 1/1986 | Jones |
| 4,609,580 | A | 9/1986 | Rockett et al. |
| 4,614,679 | A | 9/1986 | Farrington et al. |
| 4,665,342 | A | 5/1987 | Topp et al. |
| 4,707,895 | A | 11/1987 | Lang |
| 4,720,789 | A | 1/1988 | Hector et al. |
| 4,752,114 | A | 6/1988 | French |
| 4,798,754 | A | 1/1989 | Tomek |
| 4,822,669 | A | 4/1989 | Roga |
| 4,853,678 | A | 8/1989 | Bishop, Jr. et al. |
| 4,917,975 | A | 4/1990 | De Guzman |
| 4,959,265 | A | 9/1990 | Wood |
| 5,018,235 | A | 5/1991 | Stamatiou |
| 5,071,628 | A | 12/1991 | Alazet |
| 5,142,733 | A | 9/1992 | Mogez |
| 5,161,041 | A | 11/1992 | Abileah et al. |
| 5,204,159 | A | 4/1993 | Tan |
| 5,293,660 | A | 3/1994 | Park |
| 5,335,788 | A | 8/1994 | Beasley et al. |
| 5,344,693 | A | 9/1994 | Sanders |
| 5,460,381 | A | 10/1995 | Smith et al. |
| 5,461,748 | A | 10/1995 | Koiduka |
| 5,500,267 | A | 3/1996 | Canning |
| 5,556,685 | A | 9/1996 | Swicegood, Jr. |
| 5,561,446 | A | 10/1996 | Montlick |
| 5,562,580 | A | 10/1996 | Beasley et al. |
| 5,571,626 | A | 11/1996 | Cumming et al. |
| 5,589,246 | A | 12/1996 | Calhoun |
| 5,604,027 | A | 2/1997 | Sheridon |
| 5,613,313 | A | 3/1997 | Homan et al. |
| 5,646,818 | A | 7/1997 | Hahn |
| 5,658,637 | A | 8/1997 | Volz |
| 5,703,564 | A | 12/1997 | Begum et al. |
| 5,723,204 | A | 3/1998 | Stefik |
| 5,747,133 | A | 5/1998 | Vinod et al. |
| 5,805,117 | A | 9/1998 | Mazurek et al. |
| 5,815,995 | A | 10/1998 | Adams |
| 5,816,550 | A | 10/1998 | Watanabe et al. |
| 5,826,874 | A | 10/1998 | Teitell et al. |
| 5,839,976 | A | 11/1998 | Darr |
| 5,848,830 | A | 12/1998 | Castle et al. |
| 5,869,350 | A | 2/1999 | Heeger et al. |
| 5,885,684 | A | 3/1999 | Hefner et al. |
| 5,886,474 | A | 3/1999 | Asai et al. |
| 5,945,502 | A | 8/1999 | Hsieh et al. |
| 5,971,761 | A | 10/1999 | Tillman, Sr. |
| 6,001,456 | A | 12/1999 | Newland |
| 6,010,429 | A | 1/2000 | Prueitt |
| 6,084,526 | A | 7/2000 | Blotky et al. |
| 6,219,876 | B1 | 4/2001 | Blum |
| 6,233,776 | B1 | 5/2001 | Blum et al. |
| 6,353,291 | B1 | 3/2002 | Borgogno et al. |
| 6,417,778 | B1 | 7/2002 | Blum et al. |
| 6,615,526 | B1 * | 9/2003 | Pitcher et al. ..... 40/790 |
| 6,641,139 | B1 * | 11/2003 | Lamberti et al. ..... 273/378 |
| 6,914,540 | B1 * | 7/2005 | Gongolas ..... 340/908.1 |
| 2001/0011399 | A1 | 8/2001 | Blum et al. |
| 2003/0066073 | A1 | 4/2003 | Rebh |
| 2004/0004827 | A1 * | 1/2004 | Guest ..... 362/31 |

FOREIGN PATENT DOCUMENTS

| | | |
|---|---|---|
| DE | 87 01 817.9 | 4/1987 |
| DE | 3 923 959 | 10/1990 |
| DE | 3 915 254 | 11/1990 |
| DE | 40 06 781 | 9/1991 |
| DE | 4135877 | 5/1993 |
| DE | 298 11 821 | 10/1998 |
| EP | 0 009 891 | 4/1980 |
| EP | 0 188 005 | 7/1986 |
| EP | 0 199 537 | 10/1986 |
| EP | 0 202 846 | 11/1986 |
| EP | 0 353 139 | 1/1990 |
| EP | 0 354 281 | 2/1990 |
| EP | 0 359 478 | 3/1990 |
| EP | 0 365 869 | 5/1990 |
| EP | 0 374 860 | 6/1990 |
| EP | 0 421 258 | 4/1991 |
| EP | 0 448 768 | 10/1991 |
| EP | 0 512 904 | 11/1992 |
| EP | 0 514 191 | 11/1992 |
| EP | 0 554 641 | 8/1993 |
| EP | 0 573 277 | 12/1993 |
| EP | 0 624 125 | 11/1994 |
| EP | 0 624 681 | 11/1994 |
| EP | 0 648 834 | 4/1995 |
| EP | 0 721 176 | 7/1996 |
| EP | 0 751 213 | 1/1997 |
| EP | 0 794 244 | 9/1997 |
| EP | 0 839 900 | 5/1998 |
| EP | 0 895 745 | 2/1999 |
| EP | 0 971 064 | 1/2000 |
| FR | 2 532 095 | 2/1984 |
| GB | 319 416 | 9/1929 |
| GB | 433 133 | 8/1935 |
| GB | 2 182 242 | 5/1987 |
| GB | 2 263 003 A | 7/1993 |
| JP | 4 144 532 | 5/1992 |
| JP | 6-90891 | 4/1994 |
| JP | 6 189 890 | 7/1994 |
| JP | 8056810 | 3/1996 |
| JP | 08-239988 | 9/1996 |
| JP | 10-057728 | 3/1998 |
| JP | 11-109901 | 4/1999 |
| JP | 2000-105558 | 4/2000 |

| | | |
|---|---|---|
| JP | 2002-00059 | 7/2000 |
| WO | WO 91/08701 | 6/1991 |
| WO | WO 93/20536 | 10/1993 |
| WO | WO 00/07811 | 2/2000 |
| WO | WO 00/16682 | 3/2000 |
| WO | WO 00/79871 | 4/2000 |
| WO | WO 00/29209 | 5/2000 |
| WO | WO 01/27909 A1 | 2/2001 |
| WO | WO 01/77746 | 10/2001 |
| WO | WO 02/11110 | 2/2002 |
| WO | WO 02/22972 | 3/2002 |
| WO | WO 02/065451 | 8/2002 |
| WO | WO 00/19871 | 4/2003 |

OTHER PUBLICATIONS

Related co-pending U.S. Appl. No. 10/438,923, filed May 16, 2003.
Related co-pending U.S. Appl. No. 10/454,631, filed Jun. 5, 2003.
Related co-pending U.S. Appl. No. 10/682,435, filed Oct. 10, 2003.
Related co-pending U.S. Appl. No. 10/759,167, filed Jan. 20, 2004.
Patent Abstracts of Japan, vol. 1995, No. 05, Jun. 30, 1995 & JP 07 036395 A (Toray Ind Inc), Feb. 7, 1995.
Patent Abstracts of Japan, vol. 1997, No. 01, Jan. 31, 1997 & JP 08 239988 (Meitaku Syst:KK), Sep. 17, 1996.
Patent Abstracts of Japan, vol. 2002 & JP 2002 062832 A (Nippon Signal Co Ltd:The), Feb. 28, 2002.
Patent Abstracts of Japan, vol. 1995, No. 01, Feb. 28, 1995 & JP 06 299682 A (Jiyonsuton:KK), Oct. 25, 1994.
"Floor Graphics" Advertisements, Copyright 2002.
Protective Products Advertisement.
Sole-Parmer Advertisement.
3m Clean-Walk Mat., 5800 Series,TechnicalData, Jul. 1995.
Advertising Materials for Alma, (Advanced Laminated Material Applications, Inc.), ClenStep Contamination Control Mat, 12 pages, 1999.
"Displaying a Winning Glow", Michael Kenward, Technology Review, Jan./Feb. 1999, vol. 102, No. 1, 7 pages.
Screen Saviors, Michael Mattis, Business 2.0, Jul. 1999, 1 page.
"What's New", "Intelligent Ink", Advertising Material, Popular, 1 page, no date.
"Electronic Ink", Glen Sanders, ebooknet.com, 2 pages, Sep. 20, 1999.
MMR Journal, "Floor Decals New Wrinkle in P-O-P Ads", vol. 16, No. 10, p. 13, Apr. 5, 1999 USA.
Philadelphia Enquirer, "Cherry Hill, N.J. Firm Wants you to Look Down on Its Ads", Regional Newspaper, Aug. 27, 1998 USA.

* cited by examiner

DISPLAY SYSTEM FOR USE ON HORIZONTAL OR NON-HORIZONTAL SURFACES

This application claims the benefit under 35 U.S.C. § 119(e) of U.S. provisional application Ser. No. 60/526,271 filed Dec. 3, 2003. Further, this application is a continuation-in-part of application Ser. No. 10/454,631, filed Jun. 5, 2003, which claims the benefit under 35 U.S.C. § 119(e) of U.S. provisional application 60/385,579 filed Jun. 5, 2002. application Ser. No. 10/454,631 is a continuation-in-part of application Ser. No. 10/438,923, filed May 16, 2003, which claims the benefit under 35 U.S.C. § 119(e) of U.S. provisional application 60/378,070, filed May 16, 2002. application Ser. No. 10/438,923 is a continuation-in-part of application Ser. No. 10/285,639, filed Nov. 1, 2002, now U.S. Pat. No. 6,873,266, which is a continuation of application Ser. No. 10/137,357, filed May 3, 2002, and issued as U.S. Pat. No. 6,507,285 on Jan. 14, 2003. application Ser. No. 10/137,357 is a continuation of application Ser. No. 09/767,846, filed Jan. 24, 2001, and issued as U.S. Pat. No. 6,417,778 on Jul. 9, 2002. application Ser. No. 09/767,846 is a continuation of application Ser. No. 09/418,752, filed Oct. 15, 1999, and now abandoned. application Ser. No. 09/418,752 is a continuation-in-part of application Ser. No. 09/304,051, filed May 4, 1999, and issued as U.S. Pat. No. 6,219,876 on Apr. 24, 2001. Moreover, this application is a continuation-in-part of application Ser. No. 10/759,167, filed Jan. 20, 2004, which claims the benefit under 35 U.S.C. § 119(e) of U.S. provisional application Ser. No. 60/441,408, filed Jan. 22, 2003. application Ser. No. 10/759,167 is a continuation-in-part of application Ser. No. 10/682,435, now U.S. Pat. No. 6,917,301, filed Oct. 10, 2003 which claims the benefit under 35 U.S.C. § 119(e) of U.S. provisional applications identified as follows: application Ser. No. 60/418,626, filed Oct. 12, 2002; application Ser. No. 60/428,387, filed Nov. 21, 2002; and application Ser. No. 60/429,044, filed Nov. 23, 2002. application Ser. No. 10/682,435 is a continuation-in-part of application Ser. No. 10/438,923, filed May 16, 2003. Each of the above-identified applications and patents is incorporated herein in its entirety by reference.

BACKGROUND

U.S. Pat. No. 6,417,778 to Blum et al., which is fully incorporated herein by reference, describes an electronic display device associated with a floor, that enables conveying information via dynamic images and text. The present disclosure relates to various novel and advantageous features of such an electronic display device.

DETAILED DESCRIPTION

Figure 1:
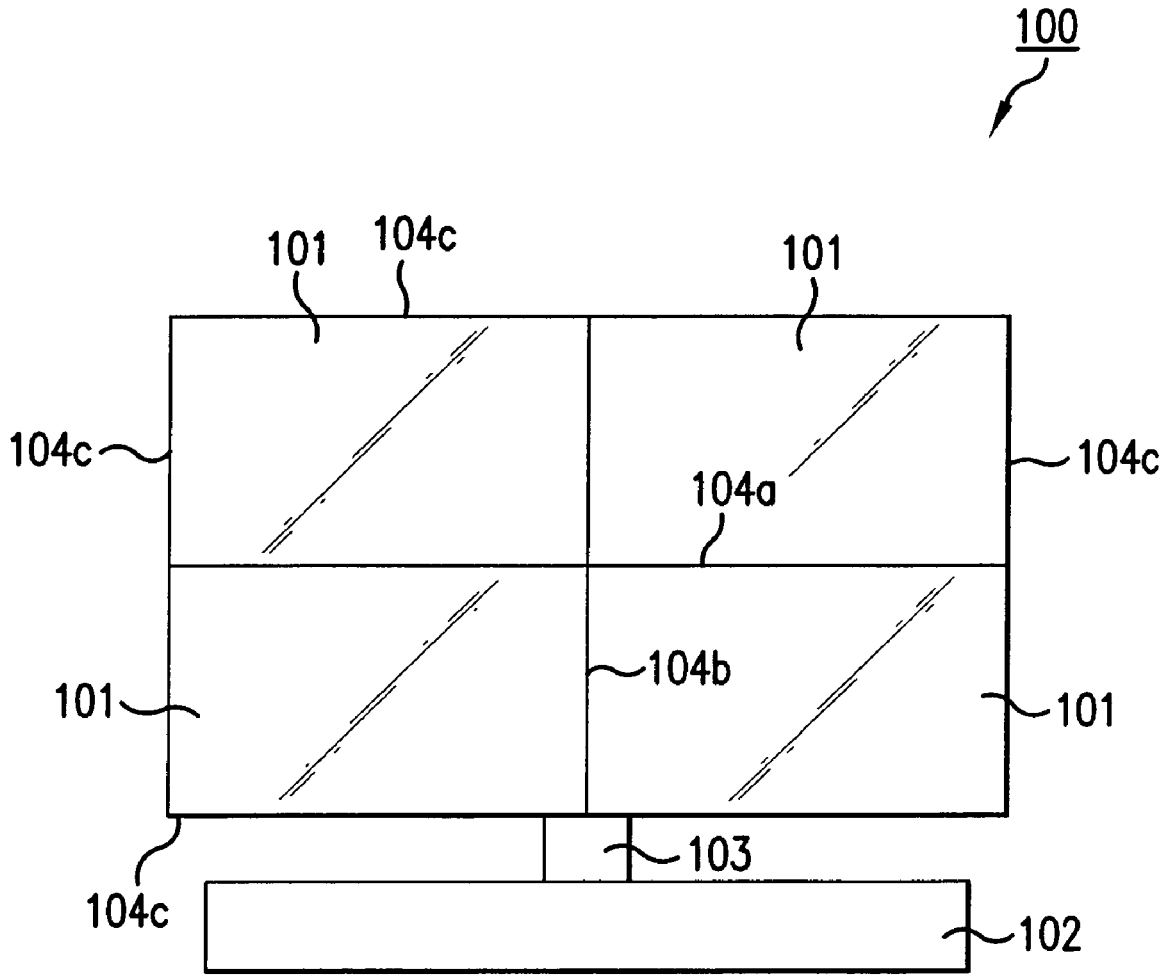
FIG. 1 shows a plan view of components of a multi-panel display system and associated control electronics according to embodiments of the present invention.

Embodiments of the present invention relate to a display system comprising an electronic display device housed within a supporting fixture, where the supporting fixture may be capable of being arranged on a substantially horizontal surface such as a floor and walked over, or of being mounted on a non-horizontal surface, including a substantially vertical surface such as a wall. To this end, the electronic display device and supporting fixture may be thin and lightweight, while also being durable and shock resistant. Control electronics for the display device may be arranged in such a way that space is conserved.

More specifically, a display system according to embodiments of the present invention may comprise an electronic display device, and a supporting fixture to house the electronic display device. The supporting fixture may include a protective covering to cover the electronic display device, a support framework to support the protective covering, an outer shell comprising a plurality of surfaces bordering the protective covering, and a base. The base, the protective covering and the outer shell may substantially enclose the electronic display device therein. The supporting fixture may be adapted to be arranged on a substantially horizontal surface and walked over while protecting the electronic display device from damage, and further comprise a mounting device to mount the supporting fixture and electronic display device to a non-horizontal surface, such as a wall.

Embodiments of the present invention further relate to a thin display system for placement on a floor, the display system comprising an electronic display device covered by a protective transparent or partly transparent covering and bordered by sloping surfaces tapering to a thin edge, the display system capable of being walked over, the sloping surfaces and thin edge to reduce the likelihood of a person tripping over the display system.

Embodiments of the present invention still further relate to a thin display system for placement on a floor, the display system comprising an electronic display device substantially enclosed within a protective transparent or partly transparent covering and a thin outer shell and base, the electronic display device being substantially centrally located with respect to the outer shell, control electronics for the electronic display device being arranged about a periphery of the electronic display device and housed within the outer shell and base.

As noted above, an electronic display device associated with a floor has been previously disclosed. More specifically, U.S. Pat. No. 6,417,778 discloses a system for electronically conveying information via an electronic display device associated with a floor. The electronic display device may incorporate a modifiable electronic display surface presenting for example, a liquid crystal display. The display could be connected to a computer and a computer generated image could be displayed on the display. Thus, the image displayed on the display could be modified by generating a different computer image and displaying that computer image on the display. The display could be associated with a base portion of a floor covering, such as included within a recess thereof, or could be included on a bottom surface, facing upward, of an insert portion of the floor covering. Alternatively, the display could be integrally formed with either of the base portion or the insert portion. The modifiable display could utilize a plurality of different graphics that can be displayed in any of a variety of manners on the display. For example, the graphics could be displayed in a generally fixed position on the display or could scroll across the display, with both exemplary methodologies displaying multiple graphics either individually or in combination.

Other alternatives for modifying graphics displayed on the floor covering include using light emitting polymers to create, and thus change, the graphics. The light emitting polymers can be either applied to, attached to, or woven into the floor covering. The light emitting polymers may be utilized on any portion of floor covering, for example, on either the base portion or the insert portion, or on any other portion of the different embodiments for the floor covering. Light emitting polymers are known and described in U.S. Pat. Nos. 5,945,502, 5,869,350, and 5,571,626, which are incorporated herein by reference in their entirety.

Other options for a display are to use electronic ink or electric paper. Electric paper is available from Xerox and is described in U.S. Pat. Nos. 5,723,204, 5,604,027, 4,126,854, and 4,143,103, which are incorporated herein by reference in their entirety. Electric paper employs thousands of tiny, electrically charged beads, called Gyricon, each about the width of a human hair, to create pixels. The two-tone beads are embedded inside a liquid-filled plastic sheeting that forms the surface of the paper. Each bead, half-black, half-white, gyrates in response to an electric field. Whether the beads are black- or white-side up determines the image. Because there's no need to refresh the image, and because the screen isn't backlit, electric paper uses only a fraction of the power used by conventional electronic displays. Electromagnetic styluses and printer-like devices can be used for getting images onto the paper.

Electronic ink is available from E Ink Corp., at 45 Spinelli Pl., Cambridge, Mass. 02138. Electronic ink uses a microencapsulated micromechanical display system. Tiny microcapsules are captured between two sheets of plastic to create pixels. Alternatively, the capsules may be sprayed on a surface. The result is a flexible display material. The tiny capsules are transparent and contain a mixture of dark ink and white paint chips. An electric charge is passed through the capsules. Depending on the electrostatic charge, the paint chips float at the top or rest on the bottom of each capsule. When the paint chips float at the top, the surface appears white. When they rest at the bottom, and thus under the ink, the surface appears black. Each of the two states is stable: black or white. A transparent electromagnetic grid laid over the sheet's surface controls the shape of the image. The display may be wirelessly connected to, for example, a computer and thus, the World Wide Web by utilizing, for example, a Motorola paging system. Text on all displays, if multiple displays are used, can be changed at once by a single editor, through a Web page.

A floor display system as disclosed above may be used in places where there is foot traffic or other (for example, wheeled shopping cart) traffic, such as entryways to stores, public buildings or homes. In such environments, strong forces may be imparted to the floor display system by the foot traffic or other traffic. Techniques for suitably protecting the electronic display device from damage due to such forces and other factors have been disclosed. The techniques include using a tough, durable protective material such as tempered glass or plastic to cover the electronic display device. More sophisticated protective structures have also been disclosed. For example, U.S. patent application Ser. No. 10/454,631, which is fully incorporated herein by reference, describes a modular protective structure for an electronic display device associated with a floor.

As described in Ser. No. 10/454,631, an electronic display assembly may comprise a plurality of display modules. A coherent display may be presented on the plurality of display modules. That is, while individual display modules may present only fragments of a display, in the aggregate the plurality of display modules may present a complete or unified display. On the other hand, each of the modules could be configured to display unrelated images and/or text.

More specifically, a display module may be an electronic display device incorporating any display technology, including those disclosed herein, and others not specifically disclosed. A display module may be configured to electronically display graphical images and alphanumeric data in either a static (not moving or changing) or dynamic (e.g., scrolling or otherwise moving or changing) format. More specifically, a display module may be coupled by wired or wireless means to a controller and modifiable via the controller to display any content chosen by a user. For example, a display module may be coupled to the controller via a display driver circuit such as a video graphics adapter card. The controller may include any kind of electronic logic circuit, for example, a general microprocessor configurable with software, or an ASIC (application specific integrated circuit). A driver of a display module may be integrated with the controller or built into an ASIC. The controller may also be in the form of a single board computer with a processor and memory and with one or more display driving circuits built onto the board, as well as wireless components for communicating with the outside world or for loading data into memory. The controller may be coupled to a storage medium, which could be any form of medium suitable for short or long term storage of digital data, including RAM (random access memory), ROM (read-only memory), flash or other non-volatile solid-state electronic storage, EEPROM (electronically erasable and programmable read only memory), or magnetic and/or optical disk storage. The storage medium may store, for example, control software for execution by the controller and video content of choice for display, under the control of the control software, by a display module.

As further described in Ser. No. 10/454,631, display modules of an assembly may be arranged within separate protective enclosures comprising a bottom member, a top member, and vertical supports or sidewalls. In embodiments, elements of the protective enclosures may be common to the display modules; for example, the protective enclosures may have a common top member, bottom member, and one or more common sidewalls. In other embodiments, each display module may have a separate protective enclosure with a distinct bottom member, top member and sidewalls. According to alternative embodiments, separate protective enclosures with distinct top and bottom members and vertical supports could be provided for each display module. A volume between the top member and display module may be provided. The vertical supports and bottom members of the protective enclosures could be made from materials including, for example, plastic, metal, glass or wood.

Advantages of the modular structures as described in Ser. No. 10/454,631 include that the structures provide excellent protection for the display modules from pressures and impacts applied to the assembly, at least in part because the pressures and impacts are shared by a system of vertical supports distributed across the assembly. Thus, the pressures and impacts are not concentrated in any particular spot, but are instead distributed and diffused among the various members forming the protective enclosures. This effect may be further enhanced by increasing the degree of segmentation, i.e., increasing the number of display modules and associated protective enclosures within the same overall area. Increasing the degree of segmentation of the display assembly could enable the display assembly to be constructed to be more thin. Generally, a thinner display assembly is desirable since this creates less obstruction to traffic and may be more lightweight. Increasing segmentation could allow vertical supports of the protective enclosures to be made shorter, and the top member or members to be made thinner.

In embodiments as described in Ser. No. 10/454,631, vertical supports may be utilized where the vertical supports do not extend continuously across the display area as beams. Instead, columns may used as vertical supports, as opposed to continuous beams. This kind of construction could be more economical with materials. In still further embodiments, the display modules may have apertures formed therein configured to receive vertical supports. The vertical supports could be any kind of projection configured to be received within a corresponding aperture in a display module. When received within apertures of a display module, the vertical supports may project beyond an upper surface of the display module to support a top protective member of a protective enclosure and provide a volume of space between the top member and the module, as described above. A protective structure utilizing features as described in the preceding may allow for a substantially thin top member or members for a protective enclosure or enclosures of the display assembly, since the structure provides for distributed vertical supports for the top member across the assembly as described above. Moreover, such a structure could be used with a single or unitary display device as opposed to modular display devices.

U.S. Ser. No. 10/682,435, which is fully incorporated herein by reference, discloses lightweight control electronics for driving a display of a display element layer in a thin, flexible display system. The control electronics may be housed within a thin, lightweight flexible frame, laterally to the display element layer.

FIG. 1 shows a plan view of at least a portion of a display system 100 according to an embodiment of the present invention. The display system 100 may comprise one or more flat display panels 101. The system 100 may further comprise control electronics 102 coupled to the display panels 101 via a connector 103. Connector 103 is intended to represent one or more connections that could be both wired and wireless. The connector 103 may be used to send control signals and to drive image data to the panels 101 from the control electronics 102, which may include image drivers. The control electronics 102 may be formed, for example, as a single board computer.

Furthermore, the display panels 101 may include any of the features and properties of the display modules described in Ser. No. 10/454,631 or others of applications incorporated herein by reference. Similarly, the control electronics 102 may include any of the features and properties of the controller described in Ser. No. 10/454,631 or others of applications incorporated herein by reference.

As illustrated in FIG. 1, the control electronics 102 may be laterally arranged with respect to (i.e., to one or more sides of) the display panels 101. The display panels 101 and the control electronics 102 may be disposed so as to lie in substantially the same plane, and may both be thin and flat. By contrast, the control electronics of conventional display systems are typically placed behind the display panel and thus the combination of the display and the control electronics tends to be somewhat bulky.

As noted, the arrangement of FIG. 1 need not include a plurality of panels 101 but could instead comprise only a single or unitary display panel coupled to control electronics. However, "tiling" a plurality of panels 101 as illustrated in FIG.1 advantageously permits a thin support structure to be formed as part of a durable, lightweight supporting fixture as described earlier. More specifically, a supporting fixture according to embodiments of the present invention may comprise thin support members 104*a*, 104*b* arranged between the display panels 101, and a perimeter portion 104*c* around a perimeter of the display panels 101. As illustrated, members 104*a* and 104*b* are transverse or perpendicular with respect to each other, and perimeter portion 104*c* outlines a rectangle, but other geometries are possible. For example, the support members 104*a*, 104*b* or portions thereof could be parallel, could be at angles other than 90° with respect to each other, or could be curved or include curved portions. Moreover, the perimeter portion 104c could define other shapes than a rectangle, such as curved or angular shapes. The support members 104*a*, 104*b* and perimeter portion 104*c* may in combination provide a support framework for one or more transparent or translucent protective coverings. The covering or coverings may be formed from a durable material such as tempered glass or plastic. As will be better seen in FIGS. 3 and 4, the perimeter portion 104*c* may be formed as part of an outer protective shell.

Like other embodiments of an electronic display device associated with a floor as described herein, the display panel or panels 101 and associated supporting fixture comprising support framework 104*a*, 104*b*, 104*c* may be used in places where there is foot traffic or other (for example, wheeled shopping cart) traffic, such as entryways to stores, public buildings or homes. Accordingly, the supporting fixture may be sturdy and durable enough that it may be repeatedly stepped on, walked over, or have a wheeled shopping cart or other rolling or sliding object traverse it, with negligible adverse effect to it or the display panel or panels that it houses. To this end, an electronic display device and associated supporting fixture according to embodiments of the present invention may include any of the structures described in Ser. No. 10/454,631.

Figure 2:
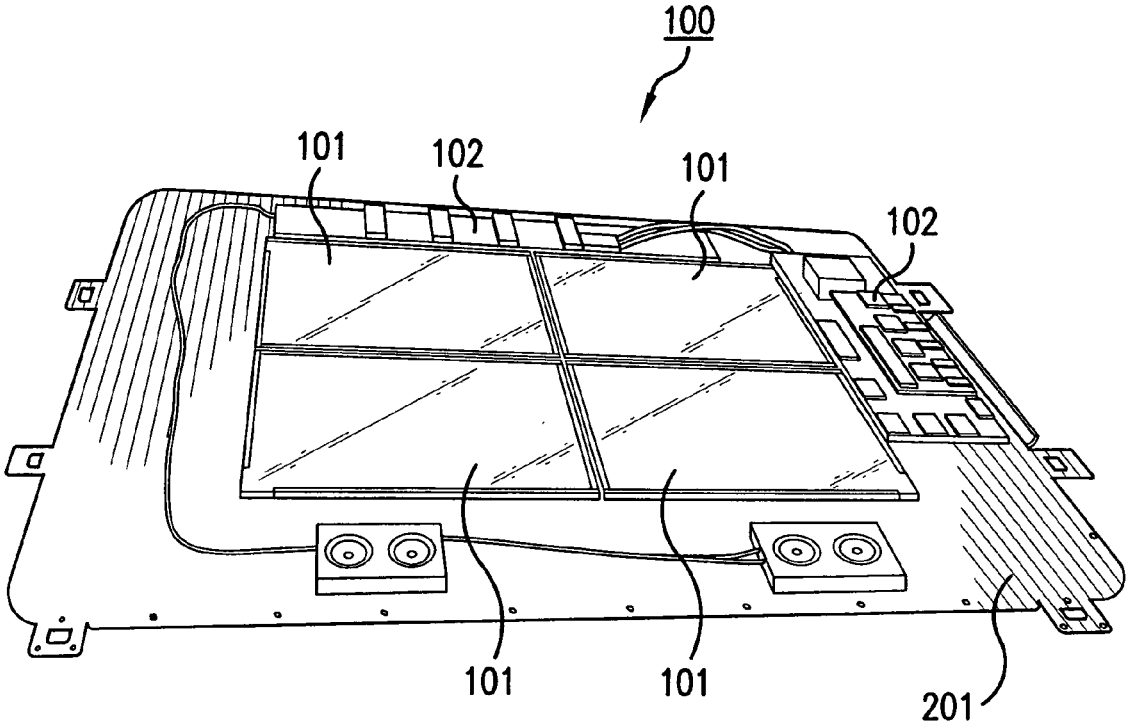
FIG. 2 shows a perspective view of components of a partly assembled multi-panel display system and associated control electronics according to embodiments of the present invention.
Figure 3:
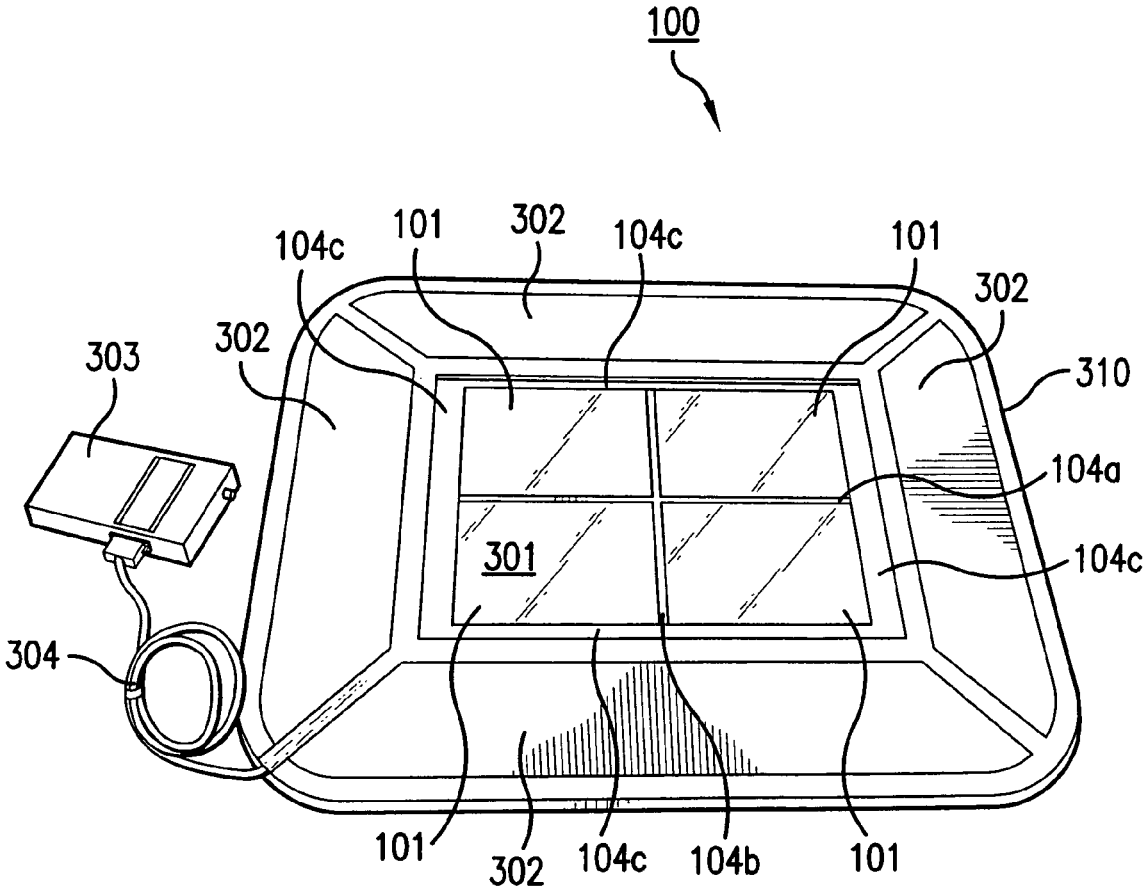
FIG. 3 shows a perspective view of a more fully assembled multi-panel display system according to embodiments of the present invention.

FIG. 2 shows a perspective view of a partly assembled display system according to embodiments of the present invention, including an electronic display device comprising four display panels 101 according to embodiments of the present invention. The display panels may sit or rest on or be affixed to a base 201. Control electronics 102 may be laterally arranged with respect to the display panels 101 and may also sit or rest on or be affixed to the base 201. FIG. 3 shows a perspective view of a more fully assembled display system 100 according to embodiments of the present invention, comprising four display panels 101 housed within a supporting fixture including support framework 104*a*, 104*b*, 104*c* and a clear or translucent protective covering 301 supported by the support framework 104*a*, 104*b*, 104*c*. In embodiments each display panel or groups of display panels could have separate protective covers.

An outer protective shell 310 comprises surfaces 302. The perimeter portion 104*c* may be formed as an inner edge of the outer protective shell 310. Surfaces 302 bordering the display panels 101 may be inclined surfaces that slope downward. For example, the surfaces 302 may begin at a level that is approximately equal to a level of a top surface of the supporting fixture, which could be a top or outer surface of the protective covering 301, and slope downward to an outer edge, so that the entire perimeter of the display system 100 presents an inclined surface to a person approaching the display system 100. Such a structure may make the display system easier to cross over, either by a person walking over the floor display system, or by a wheeled shopping cart, for example, if the display system is placed in the aisles of a commercial establishment. However, other configurations are possible for the bordering surfaces 302. For example, they need not begin to slope at a top level of the supporting fixture, but could begin to slope at a different level. The bordering surfaces 302 could include multiple different slopes, for example. The outer shell 310 comprising the bordering surfaces 302 may cover the control electronics 102 and be fastened to the base 201. In view of the foregoing, a supporting fixture for a thin electronic display device according to embodiments of the present invention may include the protective covering 301, the outer shell 310 comprising the bordering surfaces 302, the support framework 104*a*, 104*b*, 104*c*, and the base 201.

The display system 100 may further include an external power supply module 303 connected to the control electronics 102 by a power cable 304. In embodiments, additional data lines may be included with the power cable 304 and accessible via the power supply module 303.

Figure 4:
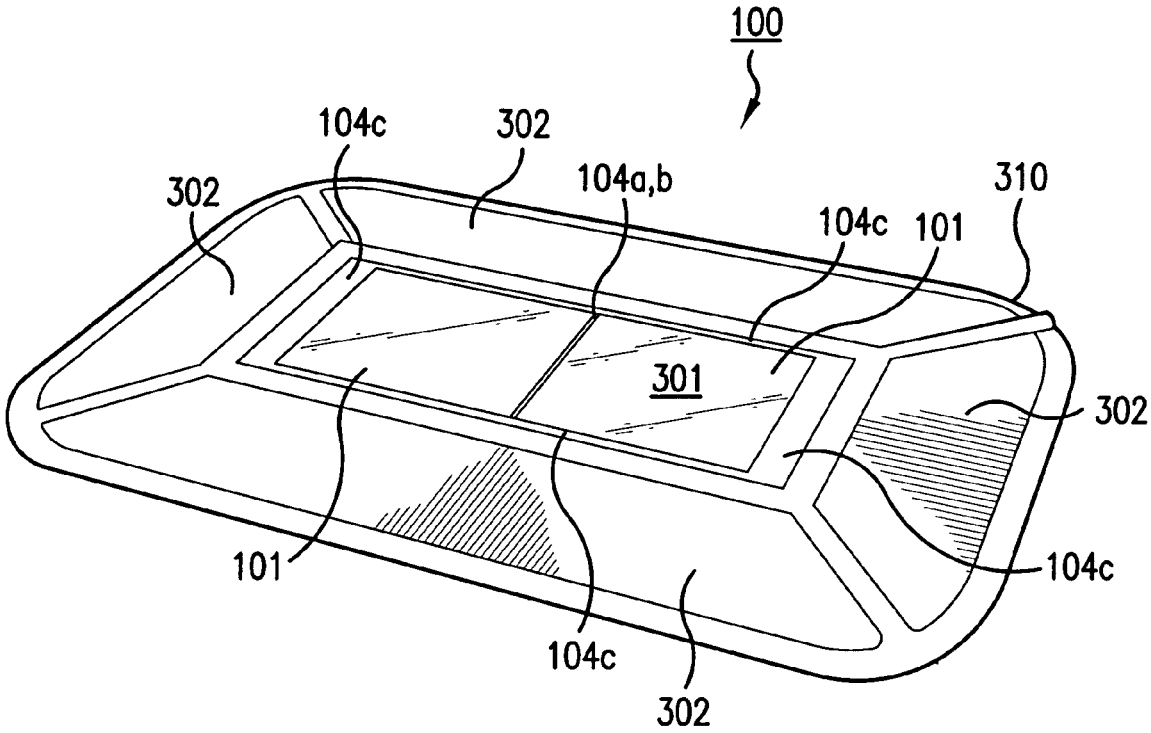
FIG. 4 shows a perspective view of another example of a more fully assembled multi-panel display system according to embodiments of the present invention.

FIG. 4 shows an alternative embodiment according to the present invention. The display system 100 of FIG. 4 comprises an electronic display device including two display panels 101, and a supporting fixture including a protective covering 301, supported by support framework 104*a* or 104*b* (depending on perspective) and 104*c*, bordering surfaces 302, and a base 201 (not visible because covered).

Figure 5:
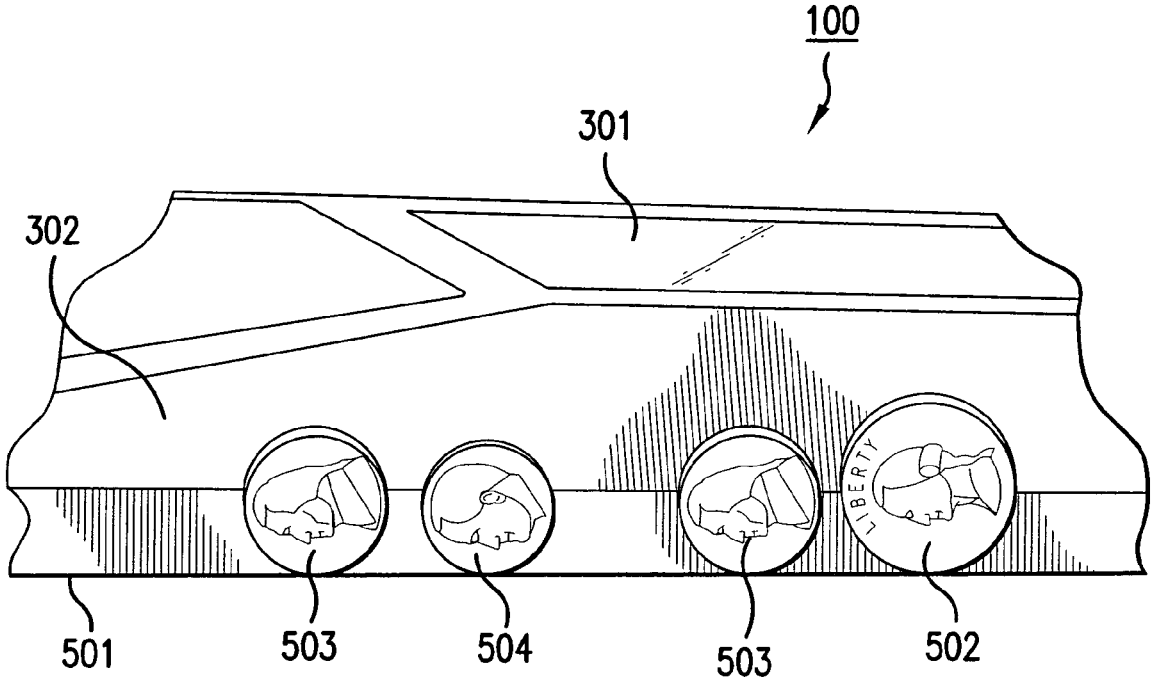
FIG. 5 shows a side elevation view with some perspective of a display system according to embodiments of the present invention.

FIG. 5 illustrates possible dimensions of a display system 100 according to embodiments of the present invention. FIG. 5 is a side elevation view that includes some perspective. An outer edge 501 of a bordering surface 302 of a protective covering 301 is in the foreground of FIG. 5. Several U.S. coins are propped up next to the edge 501 to illustrate scale. The coins include a U.S. quarter 502, two U.S. nickels 503, and a U.S. dime 504.

In embodiments, a thickest part of the display system 100 (i.e., a shortest distance from a top surface of the protective covering 301 to a bottom surface of the base 201) is from 0.3 to 1 inch thick, and preferably between 0.5 to 0.7 inches thick. A thickness of an outer edge 501 is less than 0.1 inch and is preferably between 0.02 and 0.08 inches. As noted, a bordering surface 302 may slope downward from a level that is approximately equal to a top level of the protective covering 301 to an outer edge 501. In embodiments, this slope may occur over a distance of between 6 and 12 inches, and preferably over a distance of between 8 and 10 inches.

Figure 6A:
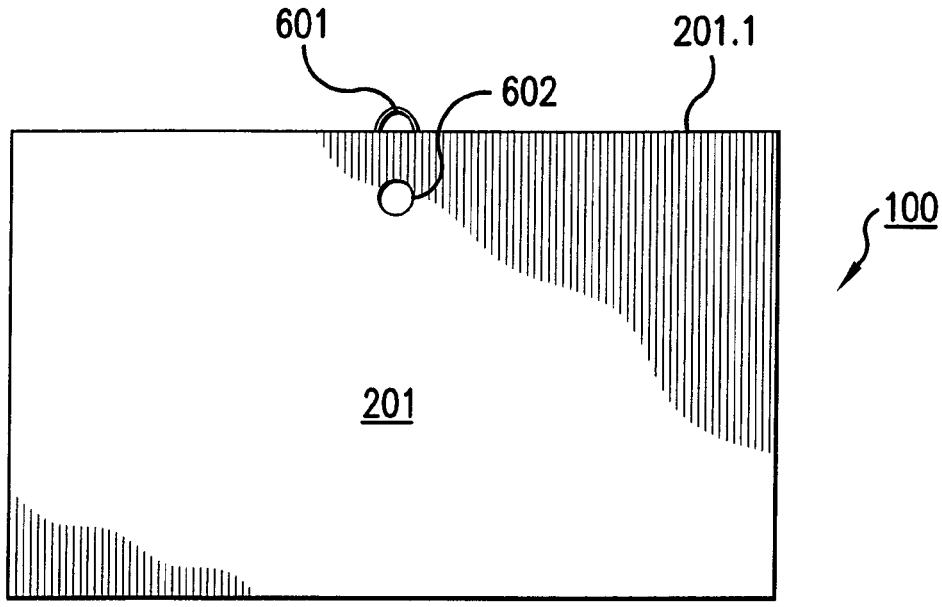
FIGS. 6A and 6B show an example of mounting devices for a display system according to embodiments of the present invention.
Figure 6B:
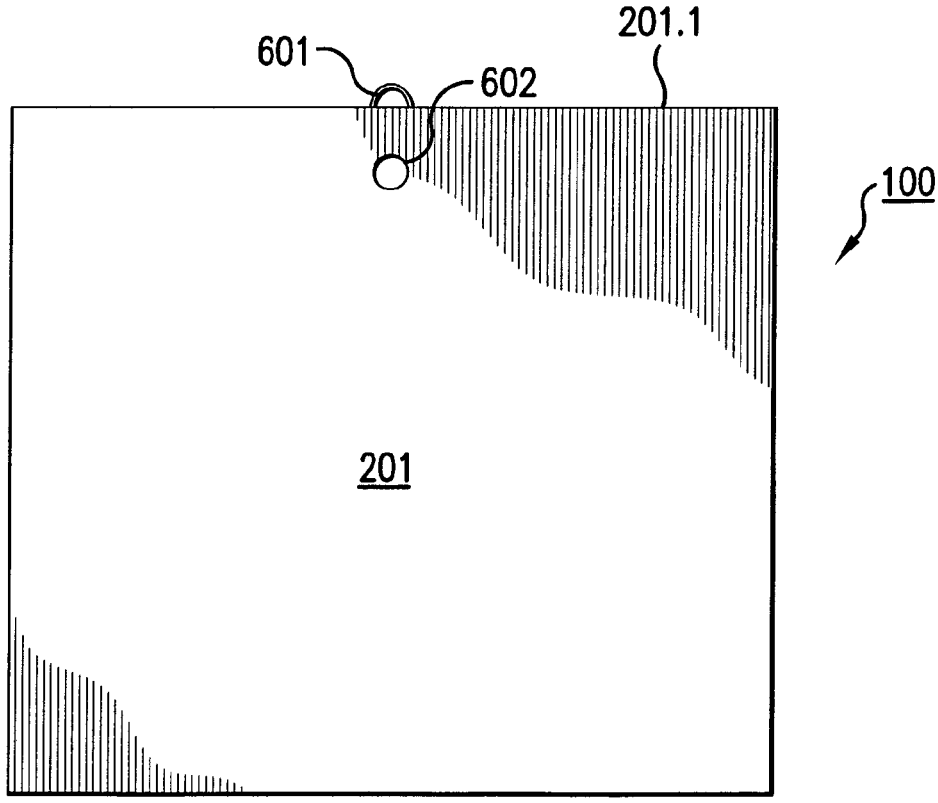

As noted earlier, in addition to being capable of being walked over when placed on a floor, embodiments of the present invention may further be capable of being mounted on a non-horizontal surface, such as a wall. FIGS. 6A and 6*b* show, respectively for a two-panel system (see FIG. 4) and a four-panel system (see FIG. 3), a bottom surface of a base 201 of a display system 100, i.e., a surface that would be in contact with a floor if the display system 100 were arranged so that the display panels faced upwardly for viewing. As illustrated in FIGS. 6A and 6B, embodiments of the present invention may further comprise a device or devices for attachment or mounting to a non-horizontal surface. The device or devices for attachment or mounting of the display system 100 to a non-horizontal surface may be included in the supporting fixture of the electronic display device, and be adapted, for example, to engage a projection from a non-horizontal surface. For example, a mounting loop 601 could be coupled to or formed integrally with the base 201, at or on an outer edge 201.1 thereof. Or, for example, a hole or recess 602 could be formed in the base 201. The mounting loop 601 or hole/recess 602 could be brought into engagement with, for example, a hook or other projection on a wall, whereby the supporting fixture and electronic display device could be suspended with the electronic display device facing outwardly for viewing. The invention is not limited, however, to a mounting loop and/or hole/recess. Any device for attaching, mounting, suspending or the like, a supporting fixture and electronic display device to a non-horizontal surface is within the scope of the present invention. For example, attachment or mounting devices associated with a supporting fixture could include a hook or hooks, hook-and-loop fasteners such as Velcro®, magnets, pins, bolts, screws and the like, and associated structures formed on or coupled to the supporting fixture, holding receptacles, brackets and the like fastenable to a wall and designed to receive the supporting fixture, et cetera. The attachment or mounting devices need not be associated with the base 201, but could also be coupled to or formed on other parts of the supporting fixture, such as outwardly or upwardly facing structures/surfaces like the bordering surfaces 302.

Embodiments of the present invention may further include any of the features or properties of the applications incorporated herein by reference. For example, embodiments of the present invention may include or be associated with an audio device, a sensing device for sensing the presence of persons and performing an action in response, variable image orientation, and interactive features including providing product information in response to customer queries. Embodiments of the present invention may further be capable of wired or wireless communication with a network.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A display system comprising an electronic display device housed within a supporting fixture, wherein the supporting fixture is adapted to be arranged on a substantially horizontal surface and walked over while protecting the electronic display device from damage, and further comprises a mounting device to mount the supporting fixture and electronic display device to a non-horizontal surface.

2. The display system of claim 1, wherein the non-horizontal surface is substantially vertical.

3. The display system of claim 1, wherein the electronic display device is capable of displaying static or dynamic images.

4. A display system comprising:

an electronic display device; and a supporting fixture to house the electronic display device, the supporting fixture including:

a protective covering to cover the electronic display device;

a support framework to support the protective covering;

an outer shell bordering the protective covering; and a base;

wherein the base, the protective covering and the outer shell substantially enclose the electronic display device therein; and wherein the supporting fixture is adapted to be arranged on a substantially horizontal surface and walked over while protecting the electronic display device from damage, and further comprises a mounting device to mount the supporting fixture and electronic display device to a non-horizontal surface.

5. The display system of claim 4, further comprising control electronics laterally arranged with respect to the electronic display device.

6. The display system of claim 5, wherein the control electronics are disposed to lie in substantially the same plane as the electronic display device.

7. The display system of claim 4, wherein the mounting device comprises a structure to engage a projection from the non-horizontal surface.

8. The display system of claim 7, wherein the mounting device includes a loop.

9. The display system of claim 7, wherein the mounting device includes a recess formed in the support structure.

10. The display system of claim 4, wherein the mounting device is coupled to or formed on the base.

11. The display system of claim 10, wherein the mounting device is coupled to or formed on an outer edge of the base.

12. The display system of claim 4, wherein a bordering surface of the outer shell has a slope.

13. The display system of claim 12, wherein the slope extends over a distance of between 6 and 12 inches.

14. The display system of claim 12, wherein the slope extends over a distance of between 8 and 10 inches.

15. The display system of claim 4, wherein a thickness of an outer edge of a bordering surface is less than 0.1 inch.

16. The display system of claim 4, wherein a thickness of an outer edge of a bordering surface is between 0.02 and 0.08 inches.

17. The display system of claim 4, wherein a thickest part of the display system is from 0.3 to 1 inch thick.

18. The display system of claim 4, wherein a thickest part of the display system is from 0.5 to 0.7 inches thick.

19. The display system of claim 4, wherein the electronic display device comprises a plurality of display panels.

20. The display system of claim 19, wherein the support framework comprises members arranged between the plurality of display panels.

21. The display system of claim 19, wherein an inner edge of the outer shell forms a perimeter of the display panels.

22. A thin display system for placement on a floor, the display system comprising an electronic display device substantially enclosed within a protective covering and a thin outer shell and base, the electronic display device being substantially centrally located with respect to the outer shell, control electronics for the electronic display device being arranged about a periphery of the electronic display device and housed within the outer shell and base.

* * * * *